United States Patent [19]

Fleig

[11] 4,129,213

[45] Dec. 12, 1978

[54] PORTABLE CRAFT AND HOBBY UNIT

[76] Inventor: William C. Fleig, 5664 Kingship Loop, Columbus, Ohio 43229

[21] Appl. No.: 803,669

[22] Filed: Jun. 6, 1977

[51] Int. Cl.[2] ..... B65D 69/00

[52] U.S. Cl. ..... 206/575; 190/11; 206/523; 206/561

[58] Field of Search ..... 190/9, 10, 11, 12 R; 229/44 R; 206/234, 224, 1.7, 1.8, 575, 350, 349, 361, 372, 523, 816, 591, 594, 570, 572, 561

[56] References Cited

U.S. PATENT DOCUMENTS

| | | | |
|---|---|---|---|
| 1,246,203 | 11/1917 | Willman | 190/11 |
| 1,495,046 | 5/1924 | Spiegel | 190/11 |
| 3,088,584 | 5/1963 | Kozikowski | 206/572 |
| 3,232,397 | 2/1966 | McCoy | 190/11 |
| 3,421,679 | 1/1969 | Goldman | 206/523 |
| 3,513,969 | 5/1970 | Roff | 206/372 |
| 3,777,882 | 12/1973 | McIntyre | 206/523 |
| 3,786,913 | 1/1974 | Crawford | 206/575 |
| 3,823,817 | 7/1974 | Hughes | 206/349 |

*Primary Examiner*—William Price
*Assistant Examiner*—Bruce H. Bernstein
*Attorney, Agent, or Firm*—T. Gene Dillahunty

[57] ABSTRACT

The invention disclosed herein is a portable case-like unit useful in the practice of crafts and hobbies, which unit comprises a base containing a working surface and storage compartments and a cover to enclose said working surface and storage compartments. The outside front wall of the base adjacent to the working surface and facing the user is substantially the same height as the top of the working surface, whereby the working surface is easily accessible by the craftsman or hobbyist. The cover contains means for preventing contents of the storage compartments from being displaced therefrom when the unit is carried.

7 Claims, 3 Drawing Figures

PORTABLE CRAFT AND HOBBY UNIT

BACKGROUND OF THE INVENTION

This invention relates to equipment generally useful in a broad variety of crafts and hobbies, such as automobile, aircraft and train model building, jewelry crafting, leather crafting, decoupage, whittling, ceramicast and assembling electronic kits. When such crafts and hobbies are practiced, they usually employ a number of tools and a variety of parts and other materials and normally require a surface upon which to work, such as a table. Such crafts or hobbies are frequently pursued at home by children and adults who have no work area available in the home specifically for their craft or hobby. Consequently, they often utilize the kitchen table, dining room table or other household furniture for that purpose.

Many crafts or hobbies involve the use of glues, paints or other chemicals, while others involve cutting, pinning or burning. When such crafts or hobbies are performed on household tables and furniture, the table top or furniture finish may be damaged thereby, unless protected with papers, cardboard or other materials. In addition, when used in the conventional manner, many crafts and hobbies involve considerable clutter, which must be gathered up and moved frequently, for example, at family meal time or similar occasion. Moreover, when papers, cardboard or other materials are used to protect the table top or furniture finish from damage, this merely adds to the clutter of materials which must be cleaned up and moved each time.

Many persons may desire to practice such crafts or hobbies while traveling away from home. However, in view of the above problems no practical way has been known for the traveler to persue crafts or hobbies while conveniently protecting the tables or other furniture in the hotel, motel or guest home in which he resides when traveling, and conveniently transporting all associated tools, materials and parts from one location to another.

PRIOR ART

Artists and craftsmen have traditionally used various cases or kits in which to carry the equipment or materials needed in their particular art or craft. Exemplary are those shown in U.S. Pat. Nos. 1,223,161; 2,940,200 and 3,446,337. While each of these prior art devices and the particular features of each serve their particular purposes, none of them fulfill the need of a means for solving the problems outlined above.

DESCRIPTION OF THE INVENTION

My invention provides means for the craftsman or hobbyist to protect the table or other household furniture upon which crafts or hobbies are practiced, and my invention simultaneously therewith further provides means for avoiding clutter and for conveniently moving or storing the materials associated therewith. Basically, my invention provides, in a single case-like unit which can be carried like a briefcase, a base containing a working surface adjacent to storage compartments and a detachable cover containing means for providing closure of the storage compartments to prevent displacement of parts and materials therefrom when the cover is attached and the case is carried.

The base is constructed with a horizontal bottom and vertical side walls and is so constructed that the front wall of the base, i.e., the side wall facing the user, is substantially shorter than the other side walls. Within the vertical side walls storage compartments are constructed adjacent the working surface. To provide maximum access to and convenience in the use of the working surface, the front side wall of the base is substantially the same height as the top of the working surface, but may be slightly higher in order to form a lip at the edge of the working surface to prevent tools or parts from rolling off the front edge of the working surface. It is not necessary that the entire front wall be shorter than the other side walls, but a sufficient portion of the front wall should be shorter in order to give unrestricted access to the working surface for the hands, wrists and arms of the craftsman or hobbyist.

The base and working surface may be constructed as one piece but preferrably are separately constructed so that the working surface can be removed, replaced or interchanged with other types of working surfaces. The working surface and the compartment in the base in which the working surface is received should be constructed so that the working surface is fixed immovably within the base and so that the adjacent storage compartments form walls around the working furface to prevent tools and parts from rolling off the working surface.

The working surface may be made of any type material and in any thickness appropriate for the craft or hobby involved. Gypsum drywall board provides an inexpensive working surface, which can be replaced frequently whenever damaged by cutting, pinning, painting, or the like. Other types of working surfaces useful to provide various functions or properties desired for a particular craft include cork, soft wood, hard wood, particle board, mar-resistant and chemical-resistant countertop materials, rubber, corrugated cardboard, metal, glass, fabric-covered substrates and poured-in-place cast resins. Different parts of the working surface, of course, may be made of different materials, depending on the particular needs of a particular craft. For example, one portion of the working surface may be hard wood or metal in order that necessary tools, such as a vice or anvil, may be firmly mounted thereon, while another portion of the working surface may be a softer material, such as gypsum board, suitable for cutting or other activity involved in the particular craft. The working surface may be a hard-surface, high-density material and made relatively thick in order for it to serve as a pounding board for such crafts as leather work or silver smith work.

The storage compartments in the base may be constructed of permanent or movable dividers and will be of various sizes as needed to hold the tools, parts and materials involved in the particular craft or hobby, as well as the partially finished or completed product of the craft or hobby. In this respect, it will be recognized that the combined height of the storage compartments in the base plus the height of the cover may be utilized to provide the space required to contain the tools and the object being made. The storage compartments will normally be open for access to the tools, parts and materials therein when the cover is removed, but the storage compartments also may be closed with individual covers for each compartments or may be used for display of the contents by using a transparent cover for each compartment.

The cover is constructed with a horizontal top and with the necessary sidewalls so that it provides a complete enclosure for the base, contacting the base at the top surfaces of the outside walls. The inside of the cover is constructed so that when the cover is attached to the base in the closed position it provides means for closing the top of the storage compartments in the base, thereby preventing displacement of the contents of the compartments when the case is moved or carried. The horizontal top may itself contact the top of the dividers forming the storage compartments thereby closing the compartments, but more conveniently the cover may contain a resilient material, such as a flexible foam pad, on the underneath side of the horizontal top to contact the top of the dividers to close the compartments. The resilient material may be attached to the cover or may be a separate component which can be placed on the base then the cover attached to the base to hold the resilient material in place, thereby closing the storage compartments. The resilient material may be in more than one piece, for example, there could be one piece employed for each storage compartment; and the resilient material need not cover the entire base, but may cover only the storage compartments desired to be closed when the cover is attached. The cover may also serve to further protect the table top or other furniture finish by providing, when detached and placed beside the base, additional surface on which to place freshly painted or glued parts for them to dry, and if placed upside down and the foam pad removed, the cover also provides a convenient receptical for such wastes as sanding dust, cuttings and the like so they can be easily and quickly disposed of without first having to clean up the area.

The means for carrying the case-like unit of my invention may be a conventional luggage or briefcase type handle attached to either the base or the cover in a conventional fashion.

The means for attaching the cover to the base likewise may be conventional luggage or briefcase latches or fasteners. However, a preferred means includes hinges on one side of the unit and a latch on the other side, wherein the hinges are the type that may be slidably disengaged thereby allowing the cover to be removed from the base when desired.

Having generally described the various aspects of my invention, I now refer to the drawing containing three figures to further describe and illustrate a specific embodiment thereof:

Figure 1:
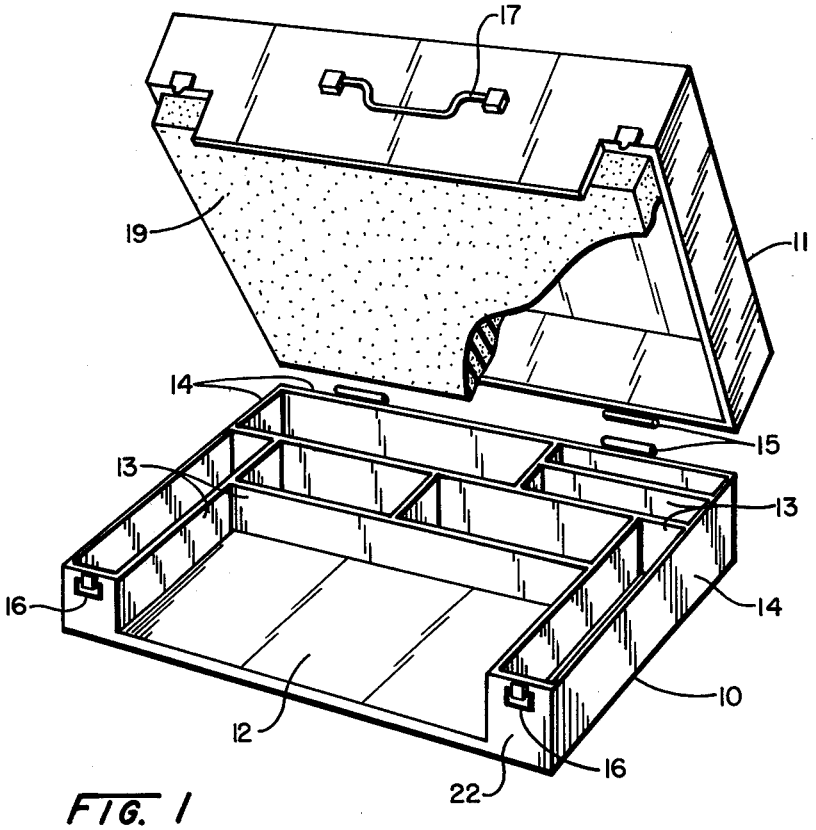
FIG. 1 shows a perspective view of the base 10 and the detached cover 11.
Figure 2:
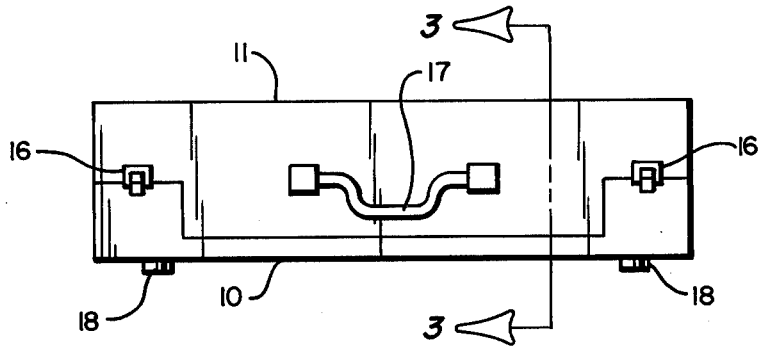
FIG. 2 shows a front profile view of the base 10 and the attached cover 11.
Figure 3:
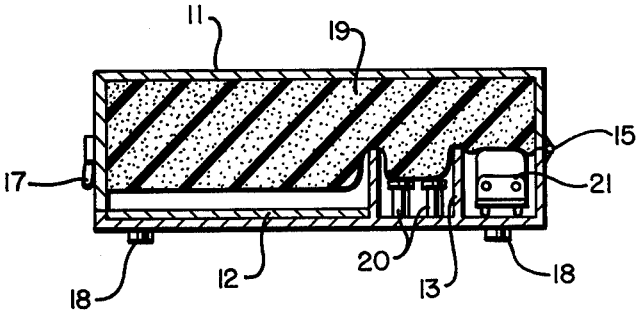
FIG. 3 shows a section view.

Base 10 contains working surface 12 and storage compartments formed by dividers 13 and outside walls 14. Base 10 and cover 11 are attached by means of hinges 15 and latches 16. Handle 17 is provided for carrying the case in a conventional manner. Base 10 has rubber pads 18 to protect the table top or other furniture surface on which the base is used. Cover 11 is fitted with a flexible foam pad 19 (illustrated in FIG. 1 in a partially cut-away view), which contacts the tops of dividers 13 when the cover is attached to the base to prevent articles, such as paint bottles 20, from falling out of their storage compartments when the case is moved or carried. Foam pad 19 also contacts the partially assembled model automobile 21 and holds it in place to prevent breakage thereof when the case is moved or carried. The storage compartments formed by dividers 13 and outside walls 14 are sized to receive paint brushes, knives, screw driver and other desired tools, as well as tubes of glue, paint bottles and parts needed for assembly. The center portion of front wall 22 of base 10 is shorter than side walls 14 and is about the same height as working surface 12, thereby providing access to working surface 12 without interferring with the users hands, wrists or arms.

In view of my description of my invention it will be obvious to those skilled in the art that this invention will be useful, in addition to those crafts and hobbies already mentioned, in a variety of others, such as plastic molding kits, clock and watch assembly and repair, glass working, soldering, entomology (such as butterfly collecting), coin collecting, stamp collecting, and the like. It will also be obvious that various accessories will be useful with or adaptable to my invention, such as a flexibly mounted light, battery powered or otherwise, to provide localized illumination of the working surface for the craftsman or hobbyist; detachable racks of the type shown in U.S. Pat. No. 2,940,200 to hold paint brushes, freshly painted or glued parts, or hot items for cooling; flexibly mounted magnifying glass useable over the working surface; and the like.

I claim:

1. A portable craft or hobby case-like unit having in combination a base, a removable cover for the base, means for attaching the removable cover to the base and means for hand carrying the case, wherein:

the base is comprised of a horizontal bottom, vertical side walls, interior walls forming compartments within said side walls for storage of tools or materials, a flat working surface adjacent to one or more of said interior walls forming one or more of said compartments and adjacent to the front wall, whereby the working surface is removable without removing any interior walls and whereby the front wall is substantially shorter than the other side walls and is substantially the same height as the top of said working surface; and the cover is comprised of a horizontal top, vertical side walls, means for preventing tools or materials from being displaced from said compartments when the case is being carried, the vertical side walls being adapted to engage said vertical side walls of the base whereby the case is enclosed when the base and cover are attached and closed, the means preventing tools or materials from being displaced from said compartments being adapted to engage the top of said compartments.

2. The unit of claim 1 wherein a portion of the front wall of the base is the same height as the side walls of the base and a portion of said front wall is substantially the same height as the top of the working surface in the base.

3. The unit of claim 1 wherein the means in the cover for preventing tools or materials from being displaced from said compartments is the horizontal top of the cover.

4. The unit of claim 1 wherein the means in the cover for preventing tools or materials from being displaced from said compartments is a flexible foam pad.

5. The unit of claim 2 wherein the means in the cover for preventing tools and materials from being displaced from said compartments is a flexible foam pad.

6. The unit of claim 1 wherein the working surface comprises a material which is drywall board, cork, wood, particle board, countertop material, rubber, cardboard, metal, glass, fabric or resin.

7. The unit of claim 6 wherein the working surface comprises two of said materials.

* * * * *